US005378217A

United States Patent [19]

D'Orta

[11] Patent Number: 5,378,217

[45] Date of Patent: Jan. 3, 1995

[54] HAND HELD EXERCISE DEVICE PROVIDING DESIRABLE AIR RESISTANCE

[76] Inventor: Frank A. D'Orta, 5602 R.D. Ave., Orlando, Fla. 32822

[21] Appl. No.: 107,372

[22] Filed: Aug. 17, 1993

[51] Int. Cl.[6] ..... A63B 21/00

[52] U.S. Cl. ..... 482/111; 482/74; 482/126; 482/139

[58] Field of Search ..... 482/44, 40, 50, 111, 482/74, 138, 92, 55, 126, 139; 441/56, 58, 59; 135/71, 72; 273/73 R, 73 J, 67 R; 440/101, 102, 104

[56] References Cited

U.S. PATENT DOCUMENTS

| | | | |
|---|---|---|---|
| 689,085 | 12/1901 | Hooper | 441/59 |
| 2,741,255 | 4/1956 | Neptune | 135/72 |
| 4,196,742 | 4/1980 | Owen, Jr. | 135/71 |
| 4,278,248 | 7/1981 | Kifferstein | 482/74 |
| 4,493,663 | 1/1985 | Richmond | 441/59 |
| 4,978,123 | 12/1990 | Ashihara | 273/67 R |
| 5,002,275 | 3/1991 | Beutler et al. | 482/111 |
| 5,038,811 | 8/1991 | Gilmore | 135/71 |
| 5,062,816 | 11/1991 | Berglund et al. | 440/101 |
| 5,207,625 | 5/1993 | White | 482/111 |

*Primary Examiner*—Richard J. Apley
*Assistant Examiner*—Lynne A. Reichard
*Attorney, Agent, or Firm*—Julian C. Renfro

[57] ABSTRACT

An air resistance device to be held in the hand of user while undertaking exercise, this device having a grasping portion and a frame portion. The grasping portion comprises a relatively straight member upon one end of which an arm clamping member is disposed, and adjacent the other end of which a handle to be grasped by the hand of the user is disposed. The frame portion is attached adjacent the handle and is of elongate rectangular configuration, with its length exceeding its width. The length of the frame portion extends generally in the same direction as the relatively straight member. The frame portion is relatively rigid and configured to receive a membrane thereon through which air cannot easily pass. Therefore, upon a membrane being attached to the frame portion, a user can derive exercise by attempting to move the device rapidly against the resistance of the ambient air. Different versions of a foldable handle arrangement are taught, and the membrane may be integral with the frame portion.

20 Claims, 2 Drawing Sheets

HAND HELD EXERCISE DEVICE PROVIDING DESIRABLE AIR RESISTANCE

BACKGROUND OF THE INVENTION

1. Field of the Invention

The present invention is concerned with a physical training accessory, and more specifically it is concerned with an accessory comprising an air-resistance member, one of which is usable on each arm of a wearer in order to deliberately increase air resistance to movements of the user's arms.

2. Description of Related Art

During the past decade, there has been an explosion of interest in physical activity as both a pastime and a means of acquiring and maintaining good health. Much of the current interest in exercise and other similar activities is based on the recent findings that correlate longevity with active lifestyles. Pursuant to this increased awareness, a corresponding increase in the variety of exercise activities has spawned a plethora of new businesses focused on servicing the needs of this new market.

In the past, a person training to attain a physical standard was required to run, walk, pedal, or otherwise move over a certain distance within a certain time period. Unfortunately, many persons in training are restricted by the limits of the training area. For example, a certain body of water or a certain running track may be all that is available for the user. A training device which permits the user to utilize a restricted training area and yet obtain the necessary exercise would be a great advance in the art of athletics.

It is a known expedient when conducting physical training to carry weights, in order to increase the effort required to carry out a particular physical movement or ground locomotion (e.g., running) and thereby enhance increases in the strength and endurance of the user. For example, it is known to wear wrist and/or ankle weights or to carry weights in the hands or in special vest pockets during running or jogging in order to increase the effort required.

The use of such weights has certain disadvantages in that, particularly in the case of long distance runners, the weights tend to stress the joints of the user. Also, the weights are localized at a particular part of the body, usually the ankles or the wrists or both, and tend to tire and stress particular muscles and joints of the user. Further, if they are not to be abandoned, the weights must be carried by the user (or someone else) even when a point is reached, for example, on the return leg of a run, at which time the weights may no longer be desired.

It is also a known expedient in the art to provide wind-sail appliances which will increase the air resistance acting upon the wearer either during ground locomotion such as skiing or ice-skating, or upon falling or jumping so that the device acts in the manner of a parachute. Each of these known prior art expedients requires that the wearer extend his or her arms in order to deploy the parachute or sail-like member.

The wind-sail devices of the prior art have the disadvantage that the wearer is constrained to maintain his or her arms in an extended position, which not only prevents the adoption of a natural arm movement and positioning for exercises such as running skating or skiing, but further requires the arms to remain extended and support the wind resistance offered by the sail, thereby limiting the duration of use of the device, inasmuch as the arms will undoubtedly become tired long before the useful or desired duration of the training period is reached.

One patentee discloses a training device comprising a rigid frame adapted to be fitted over the shoulders of the wearer, with this frame carrying an air foil which may comprise a fabric covering, and being further secured to the wearer by a belt about the wearer's waist. In one embodiment, the airfoil or sail is optional and the rigid frame, which has handles mounted on it, is sufficiently flexible so that the wearer, by maintaining his or her arms extended, may use the frame as an arm exerciser while running. Such a device is not collapsible, i.e., the airfoil is frame-mounted and therefore is not gatherable, and suffers a disadvantage similar to that of the use of weights. Also, the device must be transported even when it is no longer desired to have to overcome the added wind resistance provided by the device, and the weight of the frame must be borne at all times and, even during training, the weight is concentrated on the shoulders and at the waist.

The present invention advantageously provides a physical training accessory which provides significant advantages over these other devices, for without being burdensome to carry or maintain, it has the capability of increasing air resistance to ground locomotion by the wearer, thereby enhancing his or her training. Quite desirably, my device is lightweight and gatherable, and overcomes the stated disadvantages of prior devices such as the need to use weights, the bulkiness of such prior art devices, and the need in many instances to maintain the user's arms in an extended position for a protracted length of time.

SUMMARY OF THE INVENTION

As will be more apparent as the description proceeds, the present invention provides a physical training accessory which is worn to gain the effect of wind or air-resistance, serving to increase the effort required by the wearer to effectuate ground locomotion, typically running.

The device of this invention may be provided in an extremely lightweight form so that when borne by the wearer it provides a negligible, practically non-existent burden to the wearer. During the time of use, the air resistance provided by the device generally increases with increased velocity of locomotion of the wearer.

As will be seen in greater detail hereinafter, my novel device is typically used in pairs, with each device having a grasping portion and a frame portion. The grasping portion comprises a relatively straight member upon one end of which an arm clamping member is disposed. On the other end of the relatively straight member is a handle to be grasped by the hand of the user when the device is in use.

The frame portion is attached to the relatively straight member at a location adjacent the handle, with this frame portion being of an elongate rectangular configuration, with its length exceeding its width. As will be noted from the appended drawings, the length of the frame portion extends generally in the same direction as the relatively straight member. The frame portion is relatively rigid and configured to receive a membrane thereon, through which air cannot easily pass. As a result of this construction, upon a membrane being attached to the frame, a user can derive exercise by attempting to move the device rapidly against the resistance of the ambient air.

The frame portion is preferably constructed of lightweight tubing having several smooth, right angle bends therein. Over this frame portion, a membrane in the form of an envelope is slid and then secured thereon.

The aforementioned handle is mounted in a manner advantageously permitting it to be moved from an active position, to a compacted position enabling my novel exercise device to be stored in a minimum amount of space.

It is therefore a principal object of this invention to provide an air resistance device of lightweight, compact construction, that can be readily deployed into a usable condition so as to afford the user a desirable amount of exercise when the user attempts to move his arms vigorously against the resistance of ambient air.

It is another object of this invention to provide an inexpensive yet exceedingly durable air resistance device usable in pairs, with one device readily able to be clamped to each arm of the user, and thereafter grasped by the user in a comfortable manner, thereby making it readily convenient for the user to obtain a desirable amount of arm exercise during walking or running.

It is yet another object of this invention to provide an inexpensive yet exceedingly durable air resistance device that can be stored in minimal space by virtue of the use of a handle arrangement that can be readily moved to a compacted position.

These and other objects, features and advantages will be more apparent from a study of the appended drawings.

FIG. *2a* is a fragmentary view revealing an alternative of frame construction that may be utilized within the spirit of this invention;

FIG. *2b* is a fragmentary view revealing an alternative form of handle support, in this instance involving a hinge upon which the handle is mounted;

FIG. *3a* is a view of a preferred form of a handle able to be compacted, with the handle in this figure being in the folded, out-of-use position;

FIG. *3b* is a view related to FIG. *3a*, in which the handle is in an intermediate position; and FIG. *3c* is another relatable view, in this instance showing the handle in the active, ready-to-use position.

DETAILED DESCRIPTION

Figure 1:
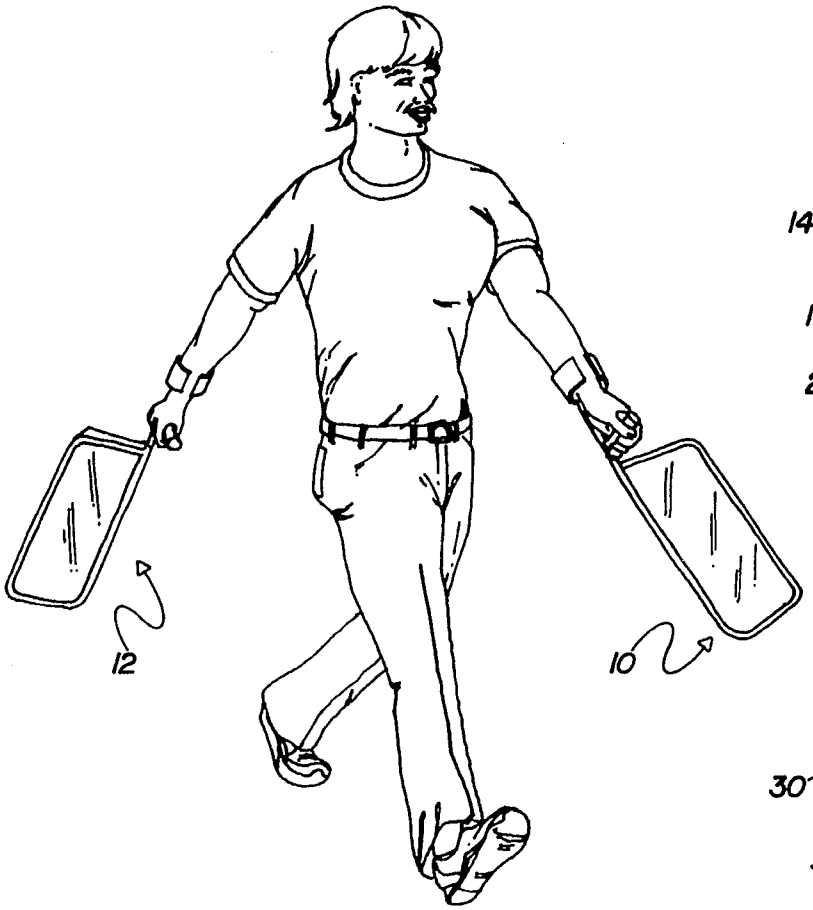
FIG. 1 is a view of a walker utilizing a pair of my novel air resistance devices.

With reference now to FIG. 1, it can be seen that I have depicted a walker utilizing a pair of my novel exercise devices, one on each arm, with the device 10 being on his left arm and the device 12 on his right arm.

It being the purpose of these devices to assist the user in obtaining a desirable amount of exercise, both of these air resistance devices are configured in a very convenient manner so as to present sufficient wind drag. Although in FIG. 1 the user is walking, it is to be understood that my devices are not to be limited to use by a walker, for they also can be used while either running or sitting. In other words, these novel devices do not require leg movement inasmuch as while in these other positions, the user still can move his arms vigorously so as to obtain a desirable amount of exercise.

Although it is typical for a user to simultaneously utilize a pair of my devices, this is not a firm requirement, for if desired, a user could make use of one of my air resistance devices on only one arm.

Figure 2A:
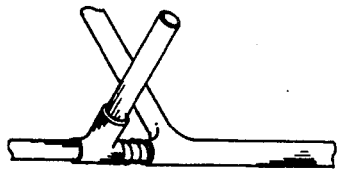
FIG. 2 is a perspective view of a typical device in accordance with this invention, revealing both the grasping portion as well as the frame portion of a typical version of my novel device.
Figure 2B:
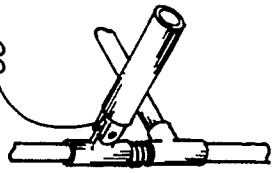
Figure 2:
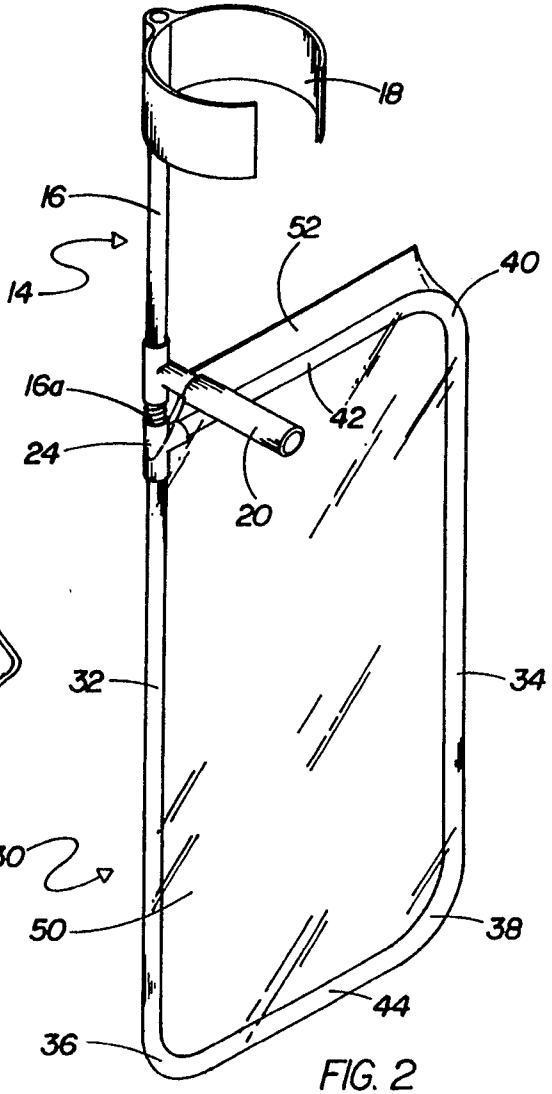

With reference now to FIG. 2, it will be seen that I have shown one of my devices in more detail, in this instance involving the use of a handle 20 mounted so as to be movable in a lateral manner. In accordance with this arrangement, the handle may be readily rotated to a compacted position for storage purposes, or alternatively, it may be easily rotated to an active position. I am not to be limited to this type of a rotational arrangement for the handle, for I may instead use a handle arrangement mounted upon a hinge, permitting the handle to be moved upwardly to a storage position when the device is not in use.

Although in FIG. 2 only a single device 10 is shown, it is to be understood that the device 12 is substantially identical, differing only in the fact that one device is designed to be worn on the left arm, and the other is designed to be worn on the right arm. In other words, one of the devices is basically the mirror image of the other.

Viewed in FIG. 2, it will be seen that this embodiment of an air resistance device 10 has a grasping portion 14 and a frame portion 30. The grasping portion 14 comprises a relatively straight tubing member 16 upon one end of which an arm clamping member 18 is disposed, and upon the other end of which a handle 20 is positioned to be grasped by the hand of the user. In this preferred embodiment, the handle is laterally rotatable between active and storage positions.

In another embodiment discussed hereinafter in conjunction with FIG. *2b*, the handle is mounted upon a hinge 66 so as to be able to be moved either to an operational, outwardly extending position, or to a folded, out-of-the-way position.

Continuing with FIG. 2, it is to be understood with regard to the arm encircling device 18, which I also refer to as a snap-on band, that this device may typically be made of spring steel covered with plastic or cloth. However, certain industrial grade plastics may be used in the construction of a snap-on band able to provide satisfactory service, gripping the arm of the user in a sufficiently tight fashion, in approximately the manner depicted in FIG. 1.

It will also be noted from FIG. 2 that a T-shaped member 24 is attached to the lower end of the relatively straight member 16, thus being positioned to be the mounting means for the frame portion 30. In other words, the frame portion 30 is attached adjacent the handle 20 by a member 16*a* representing a sturdy extension of the relatively straight member 16.

A spring bias arrangement is preferably utilized in conjunction with the handle, as will be discussed in conjunction with FIGS. *3a* through *3c*.

To provide a desirable amount of air resistance, I utilize a membrane 50 on the frame portion 30, the membrane typically taking the form of an envelope of transparent plastic that is slid over the frame and then secured in the desired position. For reasons that should be apparent, it is not desirable for air to be able to pass through the membrane 50. An alternative to the use of the envelope of transparent plastic will be discussed hereinafter.

It will be noted that the frame portion 30 is of elongate rectangular configuration, with its length exceeding its width. The length of the frame portion extends generally in the same direction as the relatively straight member 16. In one particularly satisfactory embodiment of this invention, the total length of my device was approximately 32 inches, with the length of the frame portion 30 being approximately 20 inches. In this same embodiment, the width of the frame portion was approximately 10 inches. Obviously, I am not to be limited to any particular measurements, and the foregoing is set forth merely by way of example The frame portion 30 is made up of longitudinal tubular members 32 and 34, which are preferably straight and disposed in approximately a parallel relationship. It will be noted from FIG. 2 that the upper end of longitudinal tubular member 32 is secured in the bottom aperture of the T-shaped member 24. The frame portion is preferably constructed of lightweight tubing having several smooth, right angle bends therein, such as the bends at 36, 38 and 40. A relatively short member 42 is utilized between the central aperture of T-shaped member 24, and the upper bend 40. Similarly, a relatively short member 44 is utilized between the bends 36 and 38 at the bottom of the frame, with the short members 42 and 44 preferably being of essentially identical length.

The frame portion can be made of polyvinyl chloride (PVC) tubing because of its light weight, strength, durability affordability, although I can also make the frame portion 30 out of a light metal such as of aluminum. If PVC is the selected material, it must be utilized in such a way as not to utilize on a lower portion of the frame, any connector of the type shown at 24, for a connector at such location might well interfere with ready use on the frame of a membrane through which air cannot easily pass. In other words, if PVC tubing is used, it should utilize corner bends. It was mentioned hereinabove that I prefer to use a membrane 50 in the form of an envelope slid over the frame and then secured thereon. For this reason I prefer to utilize the smooth right angle bends shown at 36 and 38, for the use of connectors in these locations might well impede the sliding of a membrane configured in the manner of an envelope over the frame 30.

In referring to the membrane 50, I utilize terminology involving the word membrane in order to connote a lightweight member through which air cannot easily pass. Although an envelope of lightweight transparent plastic is ideal for sliding over the frame 30, I am not to be limited to this material, and for example, the membrane 50 can be of cloth or other such material. More particularly, the membrane 50 could be made of cotton duck or the like and still be utilized in a satisfactory manner in the frame 30. If a lightweight cloth is used, it could be rendered airtight by the use of a sprayed-on material, such as a liquid plastic that will dry to a relatively hard finish.

The envelope or membrane 50 may be slid over the frame 30 and can be held in place by doubled-sided tape, or alternatively it can be snapped, glued, stitched or zippered into place on the frame 30. In the instance depicted in FIG. 2, the edges of the open end of the membrane 50 can be brought together as shown at 52, with these edges then being taped, stapled or glued together.

It has already been mentioned in conjunction with the embodiment of FIG. 2*b*, that the handle may be mounted upon a hinge 66 such that the handle can be pivoted between an active position extending outwardly from the plane of the frame 30, and a flat, out-of-use position in which it resides approximately in the plane of the frame 30. This is not the preferred construction, however, for I prefer to utilize a laterally rotatable handle of the type shown in FIG. 2, that can be moved laterally between an active position and a stored position.

In FIG. 2*a*, I reveal an arrangement in which the frame member is of one-piece construction, or in other words, the frame is of such construction as not to necessitate the use of a T-shaped member 24 as shown in FIG. 2. In one sense, this arrangement can be analogized with a swim flipper. In conjunction with the one-piece frame, the membrane can be attached thereto in what may be regarded as a permanent manner.

Figure 3C:
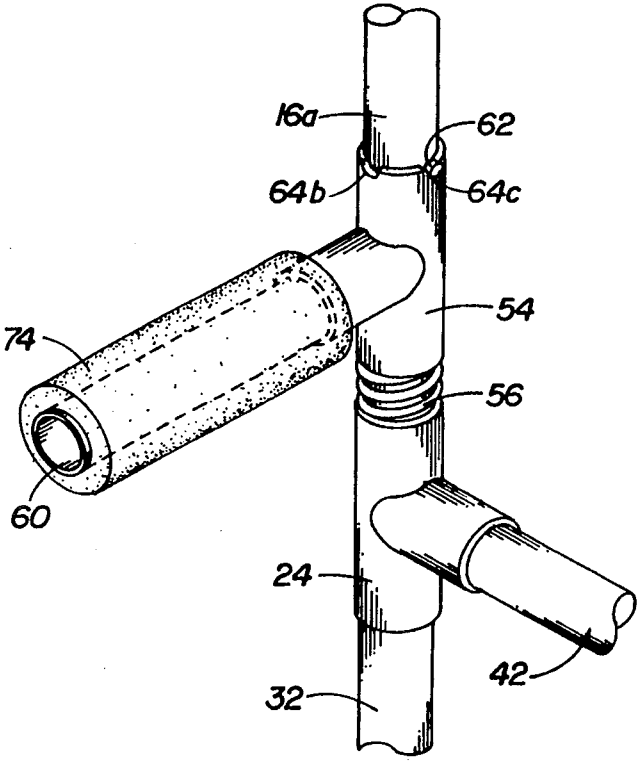
Figure 3B:
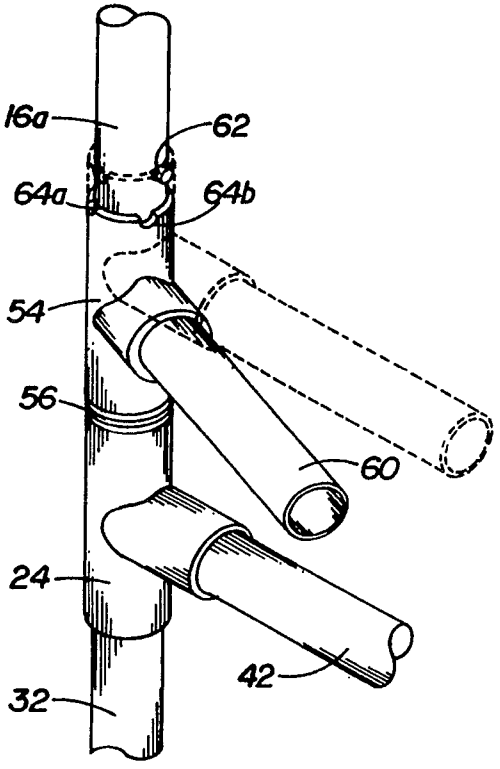
Figure 3A:
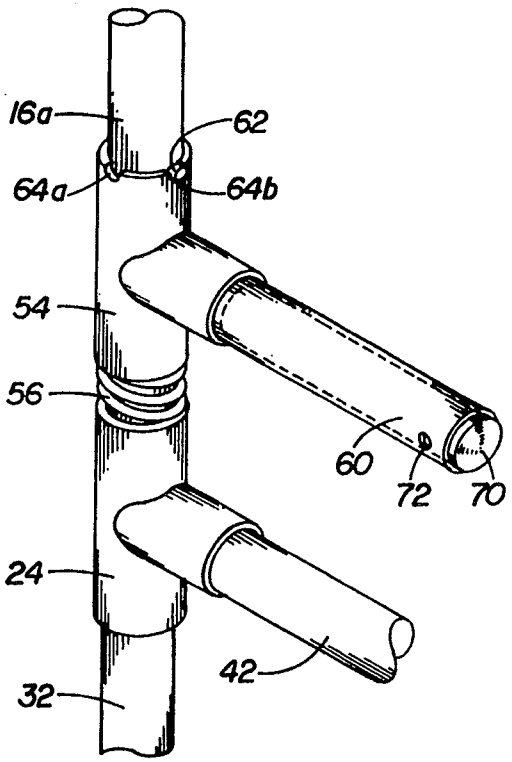

With reference to related FIGS. 3*a*, 3*b* and 3*c*, it will be seen that I have shown in FIG. 3*a*, a T-shaped member 54 that is mounted in an easily rotated manner upon vertically disposed member 16. From the embodiment illustrated in FIG. 2 it was seen that the member 16*a* may be regarded as a sturdy lower extension of member 16, and it is upon the upper end of member 16 that the arm clamping member 18 is mounted.

In FIGS. 3*a* through 3*c*, a handle 60 is mounted in the central aperture of rotatable T-shaped member 54, the handle 60 being comparable to handle 20 of FIG. 2. A compression spring 56 that encircles short sturdy member 16*a* is mounted below the T-shaped member 54, serving to bias it upwardly. The spring 56 has a large enough diameter to encircle the member 16*a* without binding. The lower end of the spring 56 bottoms against the T-shaped member 24, which in this embodiment serves the same function as the member 24 depicted in the embodiment represented by FIG. 2. It is to be noted that the lower aperture of the T-shaped member 24 receives the upper end of longitudinal member 32, whereas the middle aperture of the member 24 receives the relatively short upper member 42 of the frame 30.

Because the member 24 is to be regarded as firmly affixed to the lower end of the sturdy member 16*a*, the spring 56 is able exert an upward force against the rotatably mounted T-shaped member 54, moving it into firm contact with a pin 62 that resides in a fixed manner in the member 16 just above the member 54. The pin 62 is preferably of a length enabling it to extend outwardly for a relatively short distance beyond the member 16*a* at diametrally opposite locations, with the total length of the pin 62 approximating the external diameter of the upper end of the rotatable member 54.

As will be noted from FIG. 3*a* and the other related figures of this preferred handle embodiment, a plurality of notches 64 are formed in the upper end of member 54, with the notch arrangement preferably involving four notches placed in evenly spaced relationship about the upper edge of member 54, or in other words, a notch 64 is utilized every 90° about the upper edge of the rotatable member 54. For convenience, I have identified the notches visible in these several related figures as being notches 64*a*, 64*b* and 64*c*. For obvious reasons, I position notch 64*b* so that it is in the plane of the laterally rotatable handle 60.

The compression spring 56 serves, as mentioned above, to bias the rotatable T-shaped member 54 upwardly, so in the instance in which the handle 60 is in the out-of-use or storage position depicted in FIG. 3*a*, the notch 64*b* is in position to receive the pin 62, with this serving to hold the handle 60 firmly in the plane of the relatively short member 42 and therefore in the plane of the frame 30.

It is also to be noted in FIG. 3*a* that I may optionally utilize a weight 70 in the interior of the handle 60, and by way of example, this weight may be made of lead, although I am not to be limited to this material. The weight is affixed in the interior of the handle 60 at such time as the user wishes to add more weight, and therefore more resistance that must be overcome by the user. The weight 70 may be held in place by one or more screws 72, but as is obvious, another type of weight-securing means may be utilized if such be desirable. When desired to remove the weight 70 from the handle, this can be accomplished merely by removing the screws 72.

In FIG. 3*b* I illustrate an intermediate position of the handle 60, in which it has been rotated away from the storage position indicated in dashed lines, toward the active, outwardly extending position of the handle 60 that is depicted in FIG. 3*c*. This movement of the handle 60 is made possible by the user pushing down on the handle 60, so as to bring about a sufficient compression of the spring 56 as will permit the notch 64*b*, previously in contact with the pin 62, to move away from contact with the pin.

In FIG. 3*c*, I illustrate how the user has moved the handle 60 laterally for a 90° extent from the location shown in FIG. 3*a*, so that the handle will be in a 90° relationship to the member 42 that serves to define the upper end of the frame portion 30. The user having released the handle at this point, the spring 56 now serves to bias the rotatable member 54 upwardly, such that the notch 64*c* receives the pin 62. As a result of this arrangement, the handle 60 is now held firmly in the active or operative position in which it is in an essentially perpendicular relationship to the plane of the frame 30.

Also revealed in FIG. 3*c* is the use of an appropriate amount of padding 74 on the exterior of the handle 60, that may optionally be used to make the user's grasping of the handle more comfortable. The padding 74 may for example be in the nature of material preformed to fit a certain size handle, or it may be made of material wrapped around the handle, and then overwrapped with material designed to protect the padding. A particularly desirable option is to employ so called "grip-tape," that may utilize adhesive on one side, and present a durable, comfortable surface on the other side, able to be grasped by the user in a comfortable manner.

By now it should be clear that I have presented a lightweight air resistance device that is easy to use and convenient to carry, that may be stored in a relatively small space. Because of its relatively inexpensive design, it can be mass produced at a relatively low cost. Another point to be made is that while the device 10 intended for use on the left arm of the user cannot immediately be utilized on the user's right arm or vice versa, the frame portion 30 is essentially identical for both the left arm and the right arm devices. This of course means that one of my air resistance devices can be individualized for use on either arm, for the configuration in which one of my devices is usable depends on the particular orientation in which the connector 24 at the upper end of the device is secured on the lower end of the relatively straight member 16*a*.

With regard to the compacting of my device for storage, the handle may be constructed so as either to be moved about a hinge, in an essentially vertical plane, or it may be rotated laterally to a position in which the handle resides in the plane of the frame portion. One or the other of these alternative constructions may be utilized by a manufacturer, depending upon cost, usage and other considerations. On a low cost embodiment, the handle may be in a fixed relationship to the frame, but this is not a preferred arrangement.

I claim:

1. An air resistance device to be held in the hand of a user while undertaking exercise, said air resistance device having a grasping portion and a lightweight frame portion, said grasping portion comprising an arm clamping member as well as an adjacent handle to be grasped by the hand of the user, said lightweight frame portion being rigidly attached adjacent said grasping portion, and being of generally rectangular configuration, said lightweight frame portion being relatively rigid and constructed utilizing longitudinally disposed tubular members, which frame is configured to receive a membrane thereon, through which air will not easily pass, a membrane attached to said frame portion thus providing air resistance, so that a user can derive exercise by attempting to move said device rapidly against the resistance of the ambient air.

2. An air resistance device to be held in the hand of a user while undertaking exercise, said air resistance device having a grasping portion and a frame portion, said grasping portion comprising an arm clamping member as well as an adjacent handle to be grasped by the hand of the user, said frame portion being rigidly attached adjacent said grasping portion, and being of generally rectangular configuration, said frame portion being relatively rigid and configured to receive a membrane thereon, through which air will not easily pass, a membrane attached to said frame portion thus providing air resistance, so that a user can derive exercise by attempting to move said device rapidly against the resistance of the ambient air, said handle being movably mounted, and able to be moved at the behest of the user from an active position in which it is substantially perpendicular to said frame portion, to a storage position in which it is substantially in the plane of said frame portion, when said device is not in use.

3. The air resistance device as defined in claim 2 in which said frame portion is constructed of lightweight tubing having several smooth, right angle bends therein.

4. The air resistance device as defined in claim 2 in which said frame portion is constructed of lightweight tubing, over which a membrane in the form of an envelope is slid and then secured thereon.

5. The air resistance device as defined in claim 2 in which said frame portion is constructed of plastic, and contains thereon an integral, molded plastic membrane.

6. The air resistance device as defined in claim 2 in which said handle is rigidly mounted in an active position on said frame portion.

7. The air resistance device as defined in claim 2 in which said handle is made of cubular material, into which at least one piece of heavy metal has been inserted, said piece of heavy metal being readily removable from said handle at the behest of the user.

8. The air resistance device as defined in claim 2 in which said handle is covered with padding for the comfort of the user.

9. The air resistance device as defined in claim 2 in which said handle is mounted for lateral movement, and is able to be rotated laterally for approximately 90° when not in use.

10. The air resistance device as defined in claim 2 in which said handle is mounted on a hinge, and is able to be rotated for approximately 90° about said hinge when not in use.

11. An air resistance device to be held in the hand of a user while undertaking exercise, said device having a grasping portion and a lightweight frame portion, said grasping portion comprising a relatively straight member upon one end of which an arm clamping member is disposed, and adjacent the other end of which a handle to be grasped by the hand of the user is disposed, said lightweight frame portion being attached adjacent said handle and being of elongate rectangular configuration, with its length exceeding its width, the length of said lightweight frame portion extending generally in the same direction as said relatively straight member, said lightweight frame portion being relatively rigid, largely created by the use of tubular members, and configured to receive a membrane thereon through which air cannot easily pass, a membrane attached to said frame portion thus providing air resistance, so that a user can derive exercise by attempting to move said device rapidly against the resistance of the ambient air.

12. The air resistance device as defined in claim 11 in which said frame portion is constructed of plastic, and contains thereon an integral, molded plastic membrane.

13. The air resistance device as defined in claim 11 in which said handle is rigidly mounted in an active position on said frame portion.

14. The air resistance device as defined in claim 11 in which said handle is made of tubular material, into which at least one piece of heavy metal has been inserted, said piece of heavy metal being readily removable from said handle at the behest of the user.

15. The air resistance device as defined in claim 11 in which said handle is covered with padding for the comfort of the user.

16. An air resistance device to be held in the hand of a user while undertaking exercise, said device having a grasping portion and a frame portion, said grasping portion comprising a relatively straight member upon one end of which an arm clamping member is disposed, and adjacent the other end of which a handle to be grasped by the hand of the user is disposed, said frame portion being attached adjacent said handle and being of elongate rectangular configuration, with its length extending its width, the length of said frame portion extending generally in the same direction as said relatively straight member, said frame portion being relatively rigid and configured to receive a membrane thereon through which air cannot easily pass, a membrane attached to said frame portion thus providing air resistance, so that a user can derive exercise by attempting to move said device rapidly against the resistance of the ambient air, said handle being movably mounted, and able to be moved at the behest of the user from an active position in which it is substantially perpendicular to said frame portion, to a storage position in which it is substantially in the plane of said frame portion, when said device is not in use.

17. The air resistance device as defined in claim 16 in which said handle is mounted for lateral movement, and is able to be rotated laterally for approximately 90° when not in use.

18. The air resistance device as defined in claim 16 in which said handle is mounted on a hinge, and is able to be rotated for approximately 90° about said hinge when not in use.

19. The air resistance device as defined in claim 11 in which said frame portion is constructed of lightweight tubing having several smooth, right angle bends therein.

20. The air resistance device as defined in claim 11 in which said frame portion is constructed of lightweight tubing, over which a membrane in the form of an envelope is slid and then secured thereon.

* * * * *